US008101027B2

(12) United States Patent
Vandermeulen et al.

(10) Patent No.: US 8,101,027 B2
(45) Date of Patent: Jan. 24, 2012

(54) DETERGENT FORMULATION FOR MACHINE DISHWASHERS

(75) Inventors: Guido Vandermeulen, Ilvesheim (DE); Lidcay Herrera Taboada, Ludwigshafen (DE); Tanja Seebeck, Bensheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 121 days.

(21) Appl. No.: 12/376,840

(22) PCT Filed: Jul. 31, 2007

(86) PCT No.: PCT/EP2007/057884
§ 371 (c)(1),
(2), (4) Date: Feb. 9, 2009

(87) PCT Pub. No.: WO2008/017620
PCT Pub. Date: Feb. 14, 2008

(65) Prior Publication Data

US 2010/0167975 A1 Jul. 1, 2010

(30) Foreign Application Priority Data

Aug. 10, 2006 (EP) ..... 06118722

(51) Int. Cl.

| | |
|---|---|
| ***B08B 3/04*** | (2006.01) |
| ***C11D 1/66*** | (2006.01) |
| ***C11D 3/37*** | (2006.01) |
| ***C11D 3/26*** | (2006.01) |

(52) U.S. Cl. ..... 134/25.2; 134/25.3; 134/39; 134/42; 510/220; 510/223; 510/229; 510/230; 510/367; 510/434; 510/476; 510/477; 510/492

(58) Field of Classification Search ..... 510/220, 510/223, 229, 230, 367, 434, 476, 477, 492; 134/25.2, 25.3, 39, 42
See application file for complete search history.

(56) References Cited

U.S. PATENT DOCUMENTS

| | | | | |
|---|---|---|---|---|
| 6,271,191 | B1 * | 8/2001 | Kerobo et al. | 510/475 |
| 6,962,898 | B2 | 11/2005 | Kessler et al. | |
| 7,192,911 | B2 | 3/2007 | Sunder et al. | |
| 2003/0158064 | A1 | 8/2003 | Kessler et al. | |
| 2008/0188391 | A1 | 8/2008 | Seebeck et al. | |

FOREIGN PATENT DOCUMENTS

| | | |
|---|---|---|
| DE | 37 43 739 | 7/1989 |
| DE | 43 21 429 | 1/1995 |
| DE | 100 32 612 | 2/2002 |
| DE | 100 50 622 | 5/2002 |
| DE | 101 33 136 | 1/2003 |
| EP | 0 560 519 | 9/1993 |
| JP | 2000-355615 | * 12/2000 |

OTHER PUBLICATIONS

U.S. Appl. No. 12/376,840, filed Feb. 9, 2009, Vandermeulen, et al.
U.S. Appl. No. 12/783,726, filed May 20, 2010, Seebeck, et al.
U.S. Appl. No. 12/783,804, filed May 20, 2010, Seebeck, et al.

* cited by examiner

*Primary Examiner* — Brian P Mruk
(74) *Attorney, Agent, or Firm* — Oblon, Spivak, McClelland, Maier & Neustadt, L.L.P.

(57) ABSTRACT

The invention relates to detergent formulations for machine dishwashing which comprise copolymers having sulfonic acid and carboxylic acid functions, and to a method of using of such copolymers in machine dishwashing.

9 Claims, No Drawings

DETERGENT FORMULATION FOR MACHINE DISHWASHERS

The invention relates to detergent formulations for machine dishwashing which comprise copolymers having sulfonic acid and carboxylic acid functions, and to the use of such copolymers in machine dishwashing.

When dishware is cleaned in the machine dishwasher, the dishware is freed during the cleaning operation of soil which stems from different food residues also comprising greasy and oily constituents. The detached soil particles and components are pumped in circulation in the wash water of the machine in the course of further cleaning. It has to be ensured that the detached soil particles are efficiently dispersed and emulsified in order that they are not redeposited on the ware.

Many of the formulations present on the market are phosphate-based. The phosphate used is ideal for this application from a technical point of view, since it combines many useful properties which are sought-after in machine dishwashing. Firstly, phosphate is capable of dispersing water hardness (i.e. insoluble salts of ions such as calcium and magnesium ions). Although this is also achieved by means of the ion exchangers of the machines, a large proportion of the products for machine dishwashing is nowadays supplied in the form of so-called 3-in-1 formulations in which the function of the separate ion exchanger is no longer necessary. In such formulations, the phosphate, usually combined with phosphonates, takes over the softening of the water. Moreover, the phosphate disperses the detached soil and hence prevents redeposition of the soil on the ware.

In the case of laundry detergents, there has been a transition in many countries to entirely phosphate-free systems for ecological reasons. For the products for machine dishwashing too, there is discussion as to whether it is viable to revert to phosphate-free products. The phosphate-free products which were still on the market in the mid-1990s, however, no longer meet the current demands on the wash result. Nowadays, the consumer expects faultless streak-, film- and drip-free dishware, and preferably without use of additional rinse aid or regenerating salt for the ion exchanger.

DE-A 43 21 429 describes dishwasher detergents which are preferably phosphate-free and comprise copolymers which are formed at least from the monomers of a monoethylenically unsaturated $C_3$-$C_8$-carboxylic acid, a 2-alkylallylsulfonic acid or 2-arylallylsulfonic acid and a carbohydrate.

DE-A 37 43 739 describes preferably phosphate-free dishwasher detergents which comprise copolymers based on (meth)acrylic acid, sulfonic acids and if appropriate (meth) acrylamide.

WO-A 02/04583 describes machine dishwasher detergents which comprise copolymers of unsaturated carboxylic acids, sulfonic acid-containing monomers and if appropriate further ionic or nonionogenic monomers, and which, if appropriate, have chelate complexing agents such as ethylenediaminetetraacetic acid (EDTA) or nitrilotriacetic acid (NTA) as further ingredients. Phosphates are proposed as builder substances, provided that their use should not be avoided for ecological reasons.

Even though good results are already achieved with the known formulations, there is a great deal of room for improvement, especially as far as phosphate-free formulations with high cleaning performance are concerned.

It is therefore an object of the invention to provide phosphate-free detergent formulations for machine dishwashing, especially those which give rise to streak-, film- and drip-free dishware without use of additional rinse aid and regenerating salt.

It has now been found that the replacement of phosphate can be achieved by the use of certain sulfonic acid-containing polycarboxylates in combination with certain complexing agents.

The invention provides a detergent formulation for machine dishwashing, comprising a) from 1 to 20% by weight of one or more copolymers obtainable by polymerizing
   - aa) from 5 to 80% by weight of one or more monoethylenically unsaturated monocarboxylic acids or salts thereof,
   - bb) from 5 to 60% by weight of one or more monoethylenically unsaturated dicarboxylic acids or the salts or anhydrides thereof,
   - cc) from 1 to 50% by weight of one or more sulfo-containing, ethylenically unsaturated monomers or salts thereof and
   - dd) from 0 to 50% by weight of further ionic or nonionic monomers, b) from 1 to 50% by weight of one or more complexing agents from the group consisting of nitrilotriacetic acid, ethylenediaminetetraacetic acid and glycine-N,N-diacetic acid derivatives, glutamic acid-N,N-diacetic acid, iminodisuccinate, hydroxyiminodisuccinate, S,S-ethylenediamine-disuccinate, aspartic acid-diacetic acid and salts thereof;

c) from 1 to 15% by weight of nonionic surfactants;

d) from 0 to 30% by weight of bleaches and if appropriate bleach activators;

e) from 0 to 60% by weight of further builders;

f) from 0 to 8% by weight of enzymes and g) from 0 to 50% by weight of one or more further additives, such as anionic or zwitterionic surfactants, bleach catalysts, alkali carriers, corrosion inhibitors, defoamers, dyes, fragrances, fillers, organic solvents and water.

The invention further provides for the use of a combination of copolymers (a) and complexing agents (b) in detergent formulations for machine dishwashers, especially as builders.

The invention further provides for the use of a combination of the copolymers (a) and complexing agents (b) as a film-inhibiting additive in detergent formulations for machine dishwashing.

The invention likewise provides a process for the machine cleaning of dishware, the dishware being contacted with the above-described detergent formulation.

The inventive detergent formulation has very good washing performance and in particular prevents the formation of films, which allows the addition of phosphate to be dispensed with. The complexing agent assumes the task of complexing the ions which cause water hardness (calcium and magnesium ions) and are present in the wash water or in the food residues. Sulfo-containing polycarboxylates are in particular capable of effectively dispersing sparingly soluble salts which form from the hard water, and additionally also of dispersing the soil present in the wash liquor. The combination of the two substance classes leads to particularly good film inhibition during the machine dishwashing process.

The inventive formulations are preferably phosphate-free.

The copolymer used in accordance with the invention is obtainable by polymerizing the monomers (aa), (bb), (cc) and if appropriate (dd). The monomer (aa) is at least one monoethylenically unsaturated monocarboxylic acid. It will be appreciated that it is also possible to use mixtures of a plurality of different ethylenically unsaturated monocarboxylic acids.

Preferred monomers (aa) are monocarboxylic acids of the formula (I)

$$R^1(R^2)C{=}C(R^3)COOH \quad (I)$$

in which $R^1$, $R^2$, $R^3$ are each independently H, a straight-chain or branched alkyl radical having from 1 to 12 carbon atoms or a straight-chain or branched, mono- or polyunsaturated alkenyl radical having from 2 to 12 carbon atoms, the latter two radicals being unsubstituted or substituted, preferably by $NH_2$ and/or OH, and water-soluble salts thereof, especially alkali metal salts such as potassium and, more preferably, sodium salts, and ammonium salts.

Preference is given in particular to $C_3$-$C_6$-monocarboxylic acids and the corresponding salts.

Particularly preferred monoethylenically unsaturated monocarboxylic acids (aa) are acrylic acid, methacrylic acid, crotonic acid and vinylacetic acid. Very particularly preferred monomers are acrylic acid and methacrylic acid; acrylic acid is especially preferred. The preferences also apply correspondingly to the salts. It will be appreciated that it is also possible to use mixtures of these acids.

The monomer (bb) is preferably one or more monoethylenically unsaturated dicarboxylic acids of the general formula (II) or (III)

$$(HOOC)R^4C{=}CR^5(COOH) \quad (II)$$

$$R^4R^5C{=}C(-(CH_2)_n-COOH)(COOH) \quad (III)$$

where $R^4$ and $R^5$ are each independently H or a straight-chain or branched alkyl radical having from 1 to 20 carbon atoms and is unsubstituted or substituted, and where, in the formula (II) or (III), two $R^4$, $R^5$ radicals together may also form an alkylene radical having from 3 to 20 carbon atoms, and n is an integer from 0 to 5, and the anhydrides and water-soluble salts thereof, especially alkali metal salts such as potassium and, especially preferably, sodium salts and ammonium salts.

It is also possible to use mixtures of different monomers (bb). In the case of (I), the monomer in each case may be in the cis and/or the trans form. The monomers may also be used in the form of the corresponding carboxylic anhydrides or other hydrolyzable carboxylic acid derivatives. When the COOH groups are arranged in cis form, cyclic anhydrides may be used particularly advantageously.

$R^4$ and $R^5$ are preferably each H or an alkyl radical having from 1 to 4 carbon atoms. More preferably, $R^4$ and $R^5$ are each H or a methyl group. Preference is further given to monoethylenically unsaturated $C_4$-$C_8$-dicarboxylic acids and their corresponding salts and anhydrides.

In the case of the formula (III), $R^4$ and $R^5$ may also together be an alkylene radical which has from 3 to 20 carbon atoms and is unsubstituted or substituted. The ring formed from the double bond and the alkylene radical preferably comprises 5 or 6 carbon atoms. Examples of alkylene radicals are the 1,3-propylene or the 1,4-butylene radical which may also have further alkyl groups as substituents. n is an integer from 0 to 5, preferably from 0 to 3 and most preferably 0 or 1.

The $R^4$, $R^5$ radicals are preferably unsubstituted. Examples of suitable monomers (bb) of the formula (II) comprise maleic acid, fumaric acid, methylfumaric acid, methylmaleic acid, dimethylmaleic acid, and the corresponding cyclic anhydrides. Examples of monomers of the formula (III) comprise methylenemalonic acid and itaconic acid. Preference is given to using maleic acid, maleic anhydride and itaconic acid. It will be appreciated that it is also possible to use mixtures of these acids.

In the case of the sulfo-containing monomers (cc), preference is given to those of the formula (IV)

$$R^6(R^7)C{=}C(R^8)-X-SO_3H \quad (IV)$$

in which $R^6$, $R^7$ and $R^8$ are each independently —H, a straight-chain or branched alkyl radical having from 1 to 12 carbon atoms, a straight-chain or branched, mono- or polyunsaturated alkenyl radical having from 2 to 12 carbon atoms, the latter two radicals being unsubstituted or substituted by one or more —$NH_2$, —OH or —COOH groups, or —COOH or —$COOR^9$, or $R^6$ is also $XSO_3H$;

$R^9$ is a saturated or unsaturated, straight-chain or branched hydrocarbon radical having from 1 to 12 carbon atoms;

X is a single bond, —$(CH_2)_n$— where n=from 1 to 4, phenylene, preferably 1,4-phenylene, —$CH_2$—O-phenylene (preferably 1,4), —$CH_2$—O—$CH_2$—CH(OH)—$CH_2$—, —COO—$(CH_2)_k$— where k=from 1 to 6, —CO—NH—, —CO—NH—CR'R"—$(CH_2)_m$— where m=from 0 to 3 or —CO—NH—$CH_2$—CH(OH)—$CH_2$—;

R' is —H, —$CH_3$ or —$C_2H_5$ and

R" is —H or —$CH_3$, and water-soluble salts thereof, especially alkali metal salts such as potassium and, especially preferably, sodium salts, and ammonium salts.

Among the monomers (cc), particular preference is given to those of the formulae (IVa), (IVb) and/or (IVc)

$$H_2C{=}CH-X-SO_3H \quad (IVa)$$

$$H_2C{=}C(CH_3)-X-SO_3H \quad (IVb)$$

$$HO_3S-X-(R^{10})C{=}C(R^{11})-X-SO_3H \quad (IVc),$$

in which $R^{10}$ and $R^{11}$ are each independently —H, —$CH_3$, —$CH_2CH_3$, —$CH_2CH_2CH_3$, or —$CH(CH_3)_2$ and X is a single bond, —$(CH_2)_n$— where n=from 1 to 4, phenylene, preferably 1,4-phenylene, —$CH_2$—O-phenylene (preferably 1,4), —$CH_2$—O—$CH_2$—CH(OH)—$CH_2$—, —COO—$(CH_2)_k$— where k=from 1 to 6, —CO—NH—, —CO—NH—CR'R"—$(CH_2)_m$— where m=from 0 to 3 or —CO—NH—$CH_2$—CH(OH)—$CH_2$—;

R' is —H, —$CH_3$ or —$C_2H_5$ and

R" is —H or —$CH_3$.

Very particularly preferred sulfo-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid (2-methyl-2-propene-1-sulfonic acid), allyloxybenzenesulfonic acid, methallyloxybenzenesulfonic acid, 2-hydroxy-3-(2-propenyloxy)propanesulfonic acid, styrenesulfonic acid, vinylsulfonic acid, 3-sulfopropyl acrylate, 3-sulfopropyl methacrylate, sulfomethacrylamide, sulfomethylmethacrylamide, and water-soluble salts and esters of the acids mentioned, preference being given to the alkali metal and alkaline earth metal salts, especially the sodium and potassium salts.

Especially preferred monomers (cc) are 2-acrylamido-2-methyl-1-propanesulfonic acid, vinylsulfonic acid, methallylsulfonic acid and styrenesulfonic acid.

Useful further ionic or nonionogenic monomers (dd) include in particular ethylenically unsaturated compounds. The content in the copolymers used in accordance with the invention of monomers of group (dd) is preferably less than 20% by weight based on the copolymer. Copolymers (a) used with preference consist only of monomers of groups (aa), (bb) and (cc).

The copolymers used in accordance with the invention generally have a low pH. For mixing with components (a) and (c) and, if appropriate, (d), (e) and (f), either the copolymer solution can be used directly or the pH is adjusted by adding base or acid.

A preferred pH range for blending is generally from 5 to 11, preferably from 6 to 10 and more preferably from 6.5 to 9; it is most preferably from 7 to 8.9.

When the pH of the copolymer solution after the polymerization is lower, it can be increased by adding base. Suitable bases for this purpose are, for example, hydroxides and amines.

The copolymers used in accordance with the invention generally have a K value of from 10 to 150, preferably from 10 to 80 and more preferably from 10 to 50 (determined according to H. Fikentscher, Cellulose-Chemie, Vol. 13, p. 58 to 64 and 71 to 74 (1932); K value measured at a pH of 7 in 1% by weight aqueous solution at 25° C.).

The copolymers used in accordance with the invention preferably comprise from 10 to 80% by weight, more preferably from 20 to 70% by weight of component (aa), from 10 to 60% by weight, more preferably from 10 to 55% by weight of component (bb), from 1 to 50% by weight, more preferably from 5 to 30% by weight of component (cc) and from 0 to 10% by weight, more preferably from 0 to 5% by weight of component (dd).

The copolymers (a) may be prepared by known methods familiar to those skilled in the art.

The copolymers (a) are preferably prepared by free-radical polymerization of the monomers described. In addition to polymerization in bulk, mention should be made in particular of solution and emulsion polymerization, preference being given to solution polymerization.

The polymerization is preferably performed in water as a solvent. However, it can also be undertaken in alcoholic solvents, especially in $C_1$-$C_4$-alcohols such as methanol, ethanol and isopropanol, or in mixtures of these solvents with water.

Suitable polymerization initiators are both thermally and photochemically (photoinitiators) decomposing compounds which form radicals as they do so.

Among the thermally activable polymerization initiators, preference is given to initiators having a decomposition temperature in the range from 20 to 180° C., in particular from 50 to 120° C. Examples of suitable thermal initiators are inorganic peroxo compounds and azo compounds. These initiators may be used in combination with reducing compounds as starter/regulator systems. Examples of suitable photoinitiators are benzophenone, acetophenone, benzoin ethers, benzildialkyl ketales and derivatives thereof.

Preference is given to using thermal initiators, preference being given to inorganic peroxo compounds, especially hydrogen peroxide and in particular sodium peroxodisulfate (sodium persulfate).

If appropriate, polymerization regulators may also be used. Suitable compounds are known to those skilled in the art, for example sulfur compounds such as mercaptoethanol, 2-ethylhexyl thioglycolate, thioglycolic acid and dodecyl mercaptan.

When polymerization regulators are used, their use amount is generally from 0.1 to 15% by weight, preferably from 0.1 to 5% by weight and more preferably from 0.1 to 2.5% by weight, based on the sum of the monomers.

The polymerization temperature is generally from 30 to 200° C., preferably from 50 to 150° C. and more preferably from 80 to 130° C.

The polymerization is preferably undertaken under protective gas such as nitrogen or argon, and can be performed under atmospheric pressure, but is preferably undertaken in closed system under the autogenous pressure which develops.

The copolymers used in accordance with the invention are typically obtained in the form of a polymer solution which has a solids content of from 10 to 70% by weight, preferably from 25 to 60% by weight.

As component (b), the inventive detergent formulations comprise one or more chelate complexing agents. Chelate complexing agents are substances which form cyclic compounds with metal ions, an individual ligand occupying more than one coordination site on a central atom, i.e. being at least "bidentate". In this case, normally elongated compounds are closed to form rings by complex formation via an ion. The number of bonded ligands depends upon the coordination number of the central ion.

According to the invention, the complexing agents (b) used are selected from the group consisting of nitrilotriacetic acid, ethylenediaminetetraacetic acid and glycine-N,N-diacetic acid derivatives, glutamic acid-N,N-diacetic acid, iminodisuccinate, hydroxyiminodisuccinate, S,S-ethylenediaminedisuccinate, aspartic acid-diacetic acid and salts thereof. Preferred complexing agents (b) are methylglycinediacetic acid and salts thereof.

Preferred glycine-N,N-diacetic acid derivatives are compounds of the general formula (V)

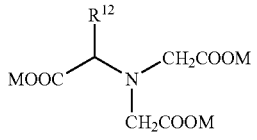

(V)

in which $R^{12}$ is $C_1$- to $C_{12}$-alkyl and

M is alkali metal or ammonium.

In the compounds of the general formula (V), M is preferably sodium or potassium, more preferably sodium.

$R^{12}$ is preferably a $C_{1-6}$-alkyl radical, more preferably a methyl or ethyl radical.

The component (b) used is particularly preferably an alkali metal salt of methylglycinediacetic acid (MGDA). Very particular preference is given to using the trisodium salt of methylglycinediacetic acid.

The preparation of the glycine-N,N-diacetic acid derivatives (V) is known; see, for example, EP-A-0 845 456 and the literature cited therein.

The inventive detergent formulations preferably comprise from 5 to 45% by weight, more preferably from 10 to 40% by weight (based on the overall formulation) of complexing agent (b).

As component (c), the inventive detergent formulations comprise nonionic surfactants, preferably weakly foaming or low-foaming nonionic surfactants. These are preferably present in proportions of from 0.1 to 15% by weight, more preferably from 0.25 to 10% by weight.

Preferred nonionic surfactants comprise the surfactants of the general formula (VI)

$$R^{13}—(OCH_2CHR^{14})_p—(OCH_2CHR^{15})_m—OR^{16} \quad (VI)$$

in which $R^{13}$ is a linear or branched alkyl radical having from 6 to 24 carbon atoms, $R^{14}$ and $R^{15}$ are different from one another and are each hydrogen or a linear or branched alkyl radical having 1-16 carbon atoms, $R^4$ is a linear or branched alkyl radical having from 1 to 8 carbon atoms and p and m are each independently integers from 0 to 300.

Preferably, p is 1-50 and m is 0-30.

The surfactants of the formula (VI) may be either random copolymers or block copolymers having one or more blocks.

In addition, it is also possible to use diblock and multiblock copolymers formed from ethylene oxide and propylene oxide, which are commercially available, for example, under the name Pluronic® (BASF Aktiengesellschaft) or Tetronic® (BASF Corporation). It is equally possible to use reaction products of sorbitan esters with ethylene oxide and/or propylene oxide. Likewise suitable are amine oxides or alkylglycosides. An overview of suitable nonionic surfactants is given, for example, by EP-A 851 023 and DE-A 198 19 187.

As component (d), the inventive detergent formulations may comprise bleaches and if appropriate bleach activators.

Bleaches subdivide into oxygen bleaches and chlorine bleaches. Oxygen bleaches which find use are, for example, alkali metal perborates and hydrates thereof, and also alkali metal percarbonates. Preferred bleaches in this context are sodium perborate in the form of the mono- or tetrahydrate, sodium percarbonate or the hydrates of sodium percarbonate.

Oxygen bleaches which can likewise be used are persulfates and hydrogen peroxide.

Typical oxygen bleaches are also organic peracids such as perbenzoic acid, peroxy-alpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid.

In addition, for example, the following oxygen bleaches may also find use in the detergent formulation:

Cationic peroxy acids which are described, for example, in the U.S. Pat. No. 5,422,028, U.S. Pat. No. 5,294,362 and U.S. Pat. No. 5,292,447;

sulfonylperoxy acids which are described, for example, in the U.S. Pat. No. 5,039,447.

Oxygen bleaches are used in amounts of generally from 0 to 30% by weight, preferably of from 1 to 20% by weight, more preferably of from 3 to 15% by weight, based on the overall detergent formulation.

Chlorine bleaches and the combination of chlorine bleaches with peroxidic bleaches may likewise be used. Known chlorine bleaches are, for example, 1,3-dichloro-5,5-dimethylhydantoin, N-chlorosulfamide, chloramine T, dichloramine T, chloramine B, N,N'-dichlorobenzoylurea, N,N'-dichloro-p-toluenesulfonamide or trichloroethylamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches are used in amounts of generally from 0 to 20% by weight, preferably of from 0.2 to 10% by weight, more preferably of from 0.3 to 8% by weight, based on the overall detergent formulation.

In addition, small amounts of bleach stabilizers, for example phosphonates, borates, metaborates, metasilicates or magnesium salts, may be added.

Bleach activators are compounds which, under perhydrolysis conditions, give rise to aliphatic peroxocarboxylic acids having preferably from 1 to 10 carbon atoms, in particular from 2 to 4 carbon atoms, and/or substituted perbenzoic acid. Suitable compounds comprise one or more N- or O-acyl groups and/or optionally substituted benzoyl groups, for example substances from the class of the anhydrides, esters, imides, acylated imidazoles or oximes. Examples are tetraacetylethylenediamine (TAED), tetraacetylmethylenediamine (TAMD), tetraacetylglycoluril (TAGU), tetraacetylhexylenediamine (TAHD), N-acylimides, for example N-nonanoylsuccinimide (NOSI), acylated phenolsulfonates, for example n-nonanoyl- or isononanoyloxy-benzenesulfonates (n- and iso-NOBS), pentaacetylglucose (PAG), 1,5-diacetyl-2,2-dioxohexahydro-1,3,5-triazine (DADHT) or isatoic anhydride (ISA). Likewise suitable as bleach activators are nitrile quats, for example, N-methylmorpholinium-acetonitrile salts (MMA salts) or trimethylammonium-acetonitrile salts (TMAQ salts).

Preferentially suitable bleach activators are from the group consisting of polyacylated alkylenediamines, more preferably TAED, N-acylimides, more preferably NOSI, acylated phenolsulfonates, more preferably n- or iso-NOBS, MMA and TMAQ.

In addition, the following substances may find use, for example, as bleach activators in the detergent formulation:

carboxylic anhydrides such as phthalic anhydride; acylated polyhydric alcohols such as triacetin, ethylene glycol diacetate or 2,5-diacetoxy-2,5-dihydrofuran; the enol esters known from DE-A 196 16 693 and DE-A 196 16 767, and also acetylated sorbitol and mannitol and the mixtures thereof described in EP-A 525 239; acylated sugar derivatives, in particular pentaacetylglucose (PAG), pentaacetylfructose, tetraacetylxylose and octaacetyllactose, and also acetylated, optionally N-alkylated, glucamine and gluconolactone, N-acylated lactams, for example N-benzoylcaprolactam, which are known from the documents WO 94/27970, WO 94/28102, WO 94/28103, WO 95/00626, WO 95/14759 and WO 95/17498.

The hydrophilically substituted acylacetals listed in DE-A 196 16 769 and the acyllactams described in DE-A 196 16 770 and WO 95/14 075 may be used, just like the combinations, known from DE-A 44 43 177, of conventional bleach activators.

Bleach activators are used in amounts of generally from 0.1 to 10% by weight, preferably of from 1 to 9% by weight, more preferably of from 1.5 to 8% by weight, based on the overall detergent formulation.

As component (e), the inventive detergent formulations may comprise further builders. It is possible to use water-soluble and water-insoluble builders, whose main task consists in binding calcium and magnesium.

The further builders used may be, for example:

low molecular weight carboxylic acids and salts thereof, such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate, α-hydroxypropionic acid;

oxidized starches, oxidized polysaccharides;

homo- and copolymeric polycarboxylic acids and salts thereof, such as polyacrylic acid, polymethacrylic acid, copolymers of maleic acid and acrylic acid;

graft polymers of monoethylenically unsaturated mono- and/or dicarboxylic acids on monosaccharides, oligosaccharides, polysaccharides, amino-polycarboxylates and polyaspartic acid;

phosphonates such as 2-phosphono-1,2,4-butanetricarboxylic acid, aminotri-(methylenephosphonic acid), 1-hydroxyethylene(1,1-diphosphonic acid), ethylenediaminetetramethylenephosphonic acid, hexamethylenediaminetetramethylenephosphonic acid or diethylenetriaminepentamethylenephosphonic acid;

silicates such as sodium disilicate and sodium metasilicate;

water-insoluble builders such as zeolites and crystalline sheet silicates.

As component (f), the inventive detergent formulations comprise one or more enzymes if appropriate. It is possible to add to the detergent between 0 and 8% by weight, preferably between 0 and 5% by weight, of enzymes based on the overall formulation in order to increase the performance of the detergent or to ensure the cleaning performance in the same quality under milder conditions. The enzymes used most frequently include lipases, amylases, cellulases and proteases. In addition, it is also possible, for example, to use esterases, pectinases, lactases and peroxidases.

The enzymes may be adsorbed on carrier substances or embedded into envelope substances in order to protect them from premature decomposition.

The inventive detergents additionally comprise, if appropriate, as component (g), further additives such as further surfactants, bleach catalysts, alkali carriers, corrosion inhibitors, defoamers, dyes, fragrances, fillers, organic solvents and water.

The inventive detergent formulations may further comprise anionic, cationic, amphoteric or zwitterionic surfactants, preferably in a blend with nonionic surfactants. Suitable anionic and zwitterionic surfactants are likewise specified in EP-A 851 023 and DE-A 198 19 187. Suitable cationic surfactants are, for example, $C_8$-$C_{16}$-dialkyldimethylammonium halides, dialkoxydimethylammonium halides or imidazolinium salts with a long-chain alkyl radical. Suitable amphoteric surfactants are, for example, derivatives of secondary or tertiary amines, such as $C_6$-$C_8$-alkyl betaines, $C_6$-$C_8$-alkyl sulfobetaines or amine oxides, such as alkyldimethylamine oxides.

In addition to or instead of the above-listed conventional bleach activators it is also possible for the sulfonimines known from EP-A 446 982 and EP-A 453 003 and/or bleach-boosting transition metal salts or transition metal complexes to be present in the inventive detergent formulations as what are known as bleach catalysts.

The useful transition metal compounds include, for example, the manganese-, iron-, cobalt-, ruthenium- or molybdenum-salene complexes known from DE-A 195 29 905 and the N-analog compounds thereof known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes which have nitrogen-containing tripod ligands and are described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EP-A 693 550, the manganese, iron, cobalt and copper complexes known from EP-A 392 592, and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleach catalysts are known, for example, from DE-A 196 13 103 and WO 95/27775.

Dinuclear manganese complexes which comprise 1,4,7-trimethyl-1,4,7-triazacyclononane (TMTACN), for example $[(TMTACN)_2Mn^{IV}Mn^{IV}(\mu\text{-}O)_3]^{2+}(PF_6^-)_2$ are likewise suitable as effective bleach catalysts. These manganese complexes are likewise described in the aforementioned documents.

Suitable bleach catalysts are preferably bleach-boosting transition metal complexes or salts from the group consisting of the manganese salts and complexes and the cobalt salts and complexes. More preferably suitable are the cobalt(amine) complexes, the cobalt(acetate) complexes, the cobalt(carbonyl) complexes, the chlorides of cobalt or manganese, manganese sulfate or $[(TMTACN)_2Mn^{IV}Mn^{IV}(\mu\text{-}O)_3]^{2+}(PF_6^-)_2$.

Bleach catalysts may, where they are used, be used in amounts of from 0.0001 to 5% by weight, preferably of from 0.0025 to 1% by weight, more preferably of from 0.01 to 0.25% by weight, based on the overall detergent formulation.

As further constituents (f) of the detergent formulation, alkali carriers may be present.

Alkali carriers are ammonium and/or alkali metal hydroxides, ammonium and/or alkali metal carbonates, ammonium and/or alkali metal hydrogencarbonates, ammonium and/or alkali metal sesquicarbonates, ammonium and/or alkali metal silicates, ammonium and/or alkali metal metasilicates and mixtures of the aforementioned substances, preference being given to using ammonium and/or alkali metal carbonates and ammonium and/or alkali metal disilicates, in particular sodium carbonate, sodium hydrogencarbonate or sodium sesquicarbonate and β- and δ-sodium disilicates $Na_2Si_2O_5.yH_2O$.

The corrosion inhibitors used may, for example, be silver protectants from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. In addition, active chlorine-containing agents which can distinctly reduce the corrosion of the silver surface frequently find use in detergent formulations. In chlorine-free detergents, preference is given to using oxygen- and nitrogen-containing organic redox-active compounds such as di- and trihydric phenols, for example hydroquinone, pyrocatechol, hydroxyhydroquinone, gallic acid, phloroglucinol, pyrogallol and derivatives of these compound classes. Salt- and complex-type inorganic compounds such as salts of the metals Mn, Ti, Zr, Hf, V, Co and Ce frequently also find use. Preference is given in this context to the transition metal salts which are selected from the group of the manganese and/or cobalt salts and/or complexes, more preferably from the group of the cobalt(amine) complexes, the cobalt(acetate) complexes, the cobalt(carbonyl) complexes, the chlorides of cobalt or manganese, and of manganese sulfate. It is likewise possible to use zinc compounds or bismuth compounds to prevent corrosion on the ware, especially glass.

Paraffin oils and silicone oils may, if appropriate, be used as defoamers and to protect plastics and metal surfaces. Defoamers are used generally in proportions of from 0.001% by weight to 5% by weight. In addition, dyes, for example patent blue, preservatives, for example Kathon CG, perfumes and other fragrances may be added to the inventive detergent formulation.

An example of a suitable filler is sodium sulfate.

The inventive detergent formulations can be processed in any desired form. Depending on the selection of the further ingredients, both liquid and solid compositions are immediately producible. In the case of the liquid compositions, liquid dishwasher detergents with viscosities of a few Pas up to gel-form compositions or even firm pastes can be produced. In the case of the solid compositions, it is possible to produce either particulate compositions such as powders, granules, extrudates, chips, pellets and flakes, or compact shaped bodies such as blocks or tablets, there being a distinct preference for the latter owing to their high consumer acceptance.

Detergent tablets for machine dishwashing may be compressed from a single premixture and thus be provided in the form of a one-phase tablet. However, it is also possible to compress a plurality of differently composed premixtures in succession, the result in the simplest case being tablets with a layer structure. Depending on the number of premixtures, two-layer, three-layer or four-layer tablets are obtained. The different layers open up the possibility of separating active ingredients from one another, in which case it is possible to separate the ingredients whose presence is obligatory in accordance with the invention from one another and other optional ingredients, for example bleaches and bleach activators.

The inventive detergent formulations may be used both for the domestic sector and for the commercial sector. Commercial detergent types comprise, for example, complexing agents such as nitrilotriacetate. Frequently, in contrast to domestic detergents, sodium hydroxide solution or potassium hydroxide solution are employed as alkali carriers. In addition, the bleaches used are frequently chlorine compounds such as sodium dichloroisocyanurate.

The invention is illustrated in detail by the examples.

EXAMPLES

Abbreviations Used

AA: acrylic acid
MA: maleic acid
IA: itaconic acid
VA: vinylsulfonic acid
AMPA: 2-acrylamido-2-methyl-1-sulfonic acid
SC: solids content
VE water: demineralized water
K value: see above

TABLE 1

Copolymers (a) used in accordance with the invention

| Example | Copolymer (percentage weight ratio) | K value | SC |
|---|---|---|---|
| 1 | AA/MA/AMPA 60/20/20 | 20.2 | 47 |
| 2 | AA/MA/VA-Na 65/22/13 | 20.2 | 51.5 |
| 3 | AA/MA/VA-Na 70/23/7 | 19.5 | 50.1 |
| 4 | AA/IA/VA-Na 56/21/23 | 22.4 | 54.1 |
| 5 | AA/IA/VA-Na 66/25/9 | 22.7 | 51.4 |
| 6 | AA/MA/VA-Na 56/30/14 | 24.5 | 45.9 |
| 7 | AA/MA/VA-Na 38/52/10 | 15.9 | 41.3 |
| 8 | AA/MA/VA-Na 37/50/13 | 14.3 | 40.1 |

EXAMPLES

Example 1

In a 2 l pilot stirrer apparatus with anchor stirrer and internal thermometer, 91.2 g of maleic anhydride and 142.5 g of VE water are sparged with nitrogen and stirred to 99° C. for 1 h. 527.3 mg of iron(II) sulfate.$7H_2O$ and 15 g of water are then added, and then, within 5 minutes, feed (1) consisting of 37.5 g of VE water and 64.9 g of triethanolamine. Subsequently, within 5 h, feed (2) consisting of 322.5 g of acrylic acid and 100 g of VE water, and feed (3) consisting of 108 g of 2-acrylamido-2-methyl-1-sulfonic acid and 241.3 of VE water are added, and, within 6 h, feed (4) consisting of 35.9 g of hydrogen peroxide (30%) in 120 g of VE water. The reaction mixture is stirred at 99° C. for a further 2 h. A brown solution is obtained. Solids content: 47%. K value: 20.2 (1% in water).

Example 2

In a 2 l pilot stirrer apparatus with anchor stirrer and internal thermometer, 91.2 g of maleic anhydride and 306.1 g of sodium vinylsulfonate (Golpanol® VS (25%)) are sparged with nitrogen and stirred to 99° C. for 1 h. 527.3 mg of iron(II) sulfate.$7H_2O$ and 15 g of water are then added, and then, within 5 minutes, feed (1) consisting of 37.5 g of VE water and 64.9 g of triethanolamine. Subsequently, within 5 h, feed (2) consisting of 324 g of acrylic acid and 246.4 g of VE water, and, within 6 h, feed (3) consisting of 30.6 g of sodium persulfate in 120 g of VE water are added. The reaction mixture is stirred at 99° C. for a further 2 h. A yellow solution is obtained. Solids content: 51.5%. K value: 20.2 (1% in water).

Example 3

In a 2 l pilot stirrer apparatus with anchor stirrer and internal thermometer, 91.2 g of maleic anhydride and 153.6 g of sodium vinylsulfonate (Golpanol® (25%)) and 28 g of VE water are sparged with nitrogen and stirred at 99° C. for 1 h. 527.3 mg of iron(II) sulfate.$7H_2O$ and 15 g of water are then added, and then, within 5 minutes, feed (1) consisting of 37.5 g of VE water and 64.9 g of triethanolamine. Subsequently, within h, feed (2) consisting of 324 g of acrylic acid and 289.1 g of VE water, and, within 6 h, feed (3) consisting of 28.3 g of sodium persulfate in 120 g of VE water are added. The reaction mixture is stirred at 99° C. for a further 2 h. A yellow solution is obtained. Solids content: 50.1%. K value: 19.5 (1% in water).

Example 4

In a 2 l pilot stirrer apparatus with anchor stirrer and internal thermometer, 121 g of itaconic acid and 510.2 g of sodium vinylsulfonate (Golpanol® VS (25.5% in VE water)) are sparged with nitrogen and heated to 99° C. 527.3 mg of iron(II) sulfate.$7H_2O$ and 15 g of water are then added. Subsequently, within 5 h, feed (1) consisting of 324 g of acrylic acid and 79.4 g of VE water, and, within 6 h, feed (2) consisting of 34.5 g of sodium persulfate in 160 g of VE water are added. The reaction mixture is stirred at 99° C. for a further 2 h. A yellow solution is obtained. Solids content: 54.1%. K value: 22.4 (1% in water).

Example 5

In a 2 l pilot stirrer apparatus with anchor stirrer and internal thermometer, 121 g of itaconic acid and 164.3 g of sodium vinylsulfonate (Golpanol® VS (25%)) and 29.8 of VE water are sparged with nitrogen and heated to 99° C. 527.3 mg of iron(II) sulfate.$7H_2O$ and 15 g of water are then added. Subsequently, within 5 h, feed (1) consisting of 324 g of acrylic acid and 210 g of VE water, and, within 6 h, feed (2) consisting of 29.2 g of sodium persulfate in 160 g of VE water are added. The reaction mixture is stirred at 99° C. for a further 2 h. A yellow solution is obtained. Solids content: 51.4%. K value: 22.7 (1% in water).

Example 6

In a 2 l pilot stirrer apparatus with anchor stirrer and internal thermometer, 148.1 g of maleic anhydride and 306.1 g of sodium vinylsulfonate (Golpanol® VS (25.5% in VE water)) are sparged with nitrogen and stirred at 99° C. for 1 h. 24.9 mg of iron(II) sulfate.$7H_2O$ and 15 g of water are then added, and then, within 5 minutes, feed (1) consisting of 60 g of VE water and 105.3 g of triethanolamine. Subsequently, within 5 h, feed (2) consisting of 324 g of acrylic acid and 221.4 g of VE water, and, within 6 h, feed (3) consisting of 17.3 g of sodium persulfate and 57.7 g of hydrogen peroxide (30%) in 162.3 g of VE water are added. The reaction mixture is stirred at 99° C. for a further 2 h. After cooling, the pH is adjusted to 7.2 with sodium hydroxide solution. A brown solution is obtained. Solids content: 45.9%. K value: 24.5 (1% in water).

Example 7

In a 2 l pilot stirrer apparatus with anchor stirrer and internal thermometer, 179.9 g of maleic anhydride, 2.1 g of phosphorous acid (50%) and 323.3 g of VE water are sparged with nitrogen, then neutralized with feed (1) consisting of 293.6 g of NaOH (50%) and heated to 95° C. Thereafter, within 4 h, feed (2) consisting of 132.1 g of acrylic acid and 136.4 g of sodium vinylsulfonate (Golpanol® VS (25%)), and feed (3) consisting of 259.6 g of sodium bisulfite, are added, and, within 4.25 h, feed (4) consisting of 17.3 g of sodium persulfate and 155.7 g of VE water is added. Subsequently, the reaction mixture is stirred at 95° C. for 1 h. After cooling, the reaction mixture is then adjusted to pH 7.2 with sodium hydroxide solution. A light brown solution is obtained. Solids content: 41.3%. K value: 15.9 (1% in water).

Example 8

In a 2 l pilot stirrer apparatus with anchor stirrer and internal thermometer, 174.6 g of maleic anhydride, 2.1 g of phosphorous acid (50%) and 159.7 g of VE water are sparged with nitrogen, then neutralized with feed (1) consisting of 285.1 g of NaOH (50%) and heated to 101-104° C. Thereafter, within 5 h, feed (2) consisting of 128.3 g of acrylic acid and 128.3 g of VE water, and feed (3) consisting of 261.9 g of sodium bisulfite, are added, and, within 3 h, feed (4) consisting of 185.4 g of sodium vinylsulfonate (Golpanol® VS (25%)) is added, and, within 5.24 h, feed (5) consisting of 17.5 g of sodium persulfate and 157.2 g of VE water. Subsequently, the reaction mixture is stirred at 101-104° C. for 1 h. After cooling, the reaction mixture is then adjusted to pH 7.2 with sodium hydroxide solution. A light brown solution is obtained. Solids content: 40.1%. K value: 14.3 (1% in water).

Use Examples

To test the inventive combinations of copolymers and complexing agents, the following formulations were used (Table 2):

TABLE 2

| Ingredients | Formulation [% by wt.] |
|---|---|
| Methylglycinediacetic acid, Na salt | 21.8 |
| Sodium citrate $2H_2O$ | 10.9 |
| Sodium carbonate | 34.9 |
| Sodium disilicate ($\times Na_2O \bullet y SiO_2$; x/y = 2.65; 80% strength) | 5.5 |
| Sodium percarbonate ($Na_2CO_4 \bullet 1.5\ H_2O$) | 10.9 |
| Tetraacetylenediamine (TAED) | 3.3 |
| Low-foaming nonionic surfactant based on fatty alcohol alkoxylates | 5.5 |
| Copolymer | 5.5 |

* The number in % by weight is based in each case on the formulation mentioned. The copolymer is in each case calculated with an active content of 100%.

The testing was effected under the test conditions below:

Dishwasher: Miele G 1140 SC

Wash cycles: 2 wash cycles, 55° C. normal (without prewash)

Ware: knives (WMF Berlin tableknives, monobloc) and glass tumblers (Matador, Ruhr Kristall);

ballast dishware: 6 black dessert plates, plastic plates (Kayser SAN plates)

Rinse temperature: 65° C.

Water hardness: 25° dH (corresponding to 445 mg of $CaCO_3$/kg)

In some of the experiments, in each case 50 g of IKW ballast soil, according to SÖFW-Journal, 124, 14/98, p. 1029, were introduced into the dishwasher at the start of the experiment.

The ware was assessed 18 h after cleaning by visual grading in a light box which had a black coating, halogen spotlight and perforated plate using a scale from 10 (very good) to 1 (very poor). The highest mark of 10 corresponds to film- and drip-free surfaces; from marks of <3, films and drips are discernible even under normal room lighting and are thus regarded as objectionable.

The results of the wash experiments are compiled in Table 3 below.

TABLE 3

| | Assessment | |
|---|---|---|
| Example | Knives | Glasses |
| 1 | 7.1 | 7.4 |
| 2 | 7.4 | 7.1 |
| 3 | 4.5 | 5.4 |
| 4 | 5 | 4.4 |
| 5 | 3.3 | 5.1 |
| 6 | 3.8 | 4 |
| 7 | 5 | 5 |
| 8 | 5.3 | 4.5 |

The invention claimed is:

1. A detergent formulation for machine dishwashing, consisting of:

a) from 1 to 20% by weight of one or more copolymers comprising the following monomers:

aa) from 5 to 80% by weight of one or more monoethylenically unsaturated monocarboxylic acids or salts thereof, bb) from 5 to 60% by weight of one or more monoethylenically unsaturated dicarboxylic acids or the salts or anhydrides thereof, and cc) from 1 to 50% by weight of one or more sulfo-containing monomers or salts thereof, b) from 1 to 50% by weight of one or more complexing agents selected from the group consisting of glycine-N,N-diacetic acid derivatives, glutamic acid-N,N-diacetic acid, iminodisuccinate, hydroxyiminodisuccinate, S,S-ethylenediaminedisuccinate, aspartic acid-diacetic acid and salts thereof;

c) from 1 to 15% by weight of at least one nonionic surfactant;

d) from 0 to 30% by weight of at least one bleach;

e) from 0 to 60% by weight of at least one further builder;

f) from 0 to 8% by weight of at least one enzyme; and g) from 0 to 50% by weight of at least one further additive selected from the group consisting of an anionic surfactant, zwitterionic surfactant, bleach catalyst, bleach activator, alkali carrier, corrosion inhibitor, defoamer, dye, fragrance, and filler, and (h) water.

2. The detergent formulation according to claim 1, wherein the monomers (aa) are monocarboxylic acids of the formula (I)

$$R^1(R^2)C{=}C(R^3)COOH \quad (I),$$

in which $R^1$, $R^2$, $R^3$ are each independently H, a straight-chain or branched alkyl radical having from 1 to 12 carbon atoms or a straight-chain or branched, mono- or polyunsaturated alkenyl radical having from 2 to 12 carbon atoms, wherein the latter two radicals are unsubstituted or substituted, and water-soluble salts thereof.

3. The detergent formulation according to claim 2, wherein the monoethylenically unsaturated monocarboxylic acids (aa) are selected from the group consisting of acrylic acid, methacrylic acid, crotonic acid and vinylacetic acid.

4. The detergent formulation according to claim 1, wherein the monomer (bb) is one or more monoethylenically unsaturated dicarboxylic acids of the formula (II) or (III):

$$(HOOC)R^4C{=}CR^5(COOH) \quad (II)$$

$$R^4R^5C{=}C(-(CH_2)_n-COOH)(COOH) \quad (III)$$

wherein $R^4$ and $R^5$ are each independently H or a straight-chain or branched alkyl radical having from 1 to 20 carbon atoms and is unsubstituted or substituted, and in the formula (II) or (III), two $R^4$, $R^5$ radicals together may also form an alkylene radical having from 3 to 20 carbon atoms, and n is an integer from 0 to 5, or the anhydrides and water-soluble salts thereof.

5. The detergent formulation according to claim 4, wherein the monomers (bb) are selected from the group consisting of maleic acid, fumaric acid, methylfumaric acid, methylmaleic acid, dimethylmaleic acid and their cyclic anhydrides, methylenemalonic acid and itaconic acid.

6. The detergent formulation according to claim 1, wherein the sulfonic acid-containing monomers (cc) are represented by the formula (IV):

$$R^6(R^7)C{=}C(R^8)-X-SO_3H \quad (IV),$$

wherein $R^6$, $R^7$ and $R^8$ are each independently —H, a straight-chain or branched alkyl radical having from 1 to 12 carbon atoms, a straight-chain or branched, mono- or polyunsaturated alkenyl radical having from 2 to 12 carbon atoms, the latter two radicals being unsubstituted or substituted by one or more $-NH_2$, —OH or —COOH groups, or —COOH or $-COOR^S$, or $R^6$ is also $XSO_3H$;

$R^9$ is a saturated or unsaturated, straight-chain or branched hydrocarbon radical having from 1 to 12 carbon atoms;

X is a single bond, $-(CH_2)_n-$ where n=from 1 to 4, phenylene, $-CH_2-O$-phenylene, $-CH_2-O-CH_2-CH(OH)-CH_2-$, $-COO-(CH_2)_k-$ where k=from 1 to 6, —CO—NH—, $-CO-NH-CR'R''-(CH_2)_m-$ where m=from 0 to 3 or $-CO-NH-CH_2-CH(OH)-CH_2-$;

R' is —H, $-CH_3$ or $-C_2H_5$, and

R" is —H or $-CH_3$, or water-soluble salts thereof.

7. The detergent formulation according to claim 6, wherein sulfo-containing monomers are selected from the group consisting of 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid (2-methyl-2-propene-1-sulfonic acid), allyloxybenzenesulfonic acid, methallyloxybenzenesulfonic acid, 2-hydroxy-3-(2-propenyloxy)propanesulfonic acid, styrenesulfonic acid, vinylsulfonic acid, 3-sulfopropyl acrylate, 3-sulfopropyl methacrylate, sulfomethacrylamide, sulfomethylmethacrylamide, and water-soluble salts and esters of the acids mentioned.

8. A process for the machine washing of dishware, comprising:

contacting the dishware with a detergent formulation according to claim 1.

9. The detergent formulation according to claim 1, comprising one or more bleach activators.

* * * * *